US005761565A

United States Patent [19]

Baker et al.

[11] Patent Number: 5,761,565

[45] Date of Patent: Jun. 2, 1998

[54] COLOR HIGHLIGHTING ACCESSORY FOR A MONOCHROMATIC PRINTER

[75] Inventors: Ronald Willard Baker, Versailles; Martin Victor DiGirolamo; Stanley Dyer, both of Lexington; Michael Craig Leemhuis, Nicholasville; Bernard Lee Wilzbach, Lexington, all of Ky.

[73] Assignee: Lexmark International, Inc., Lexington, Ky.

[21] Appl. No.: 679,860

[22] Filed: Jul. 15, 1996

[51] Int. Cl.[6] ..... G03G 15/00

[52] U.S. Cl. ..... 399/2

[58] Field of Search ..... 399/1, 2, 6, 130; 347/2, 3

[56] References Cited

U.S. PATENT DOCUMENTS

| | | | |
|---|---|---|---|
| 4,511,907 | 4/1985 | Fukuchi | 346/140 |
| 4,630,921 | 12/1986 | Watanabe | 399/2 |
| 4,653,895 | 3/1987 | Deguchi et al. | 351/1 |
| 4,899,338 | 2/1990 | Wroblewski | 370/85.1 |
| 4,951,564 | 8/1990 | Wilson et al. | 101/93.12 |
| 5,081,596 | 1/1992 | Vincent et al. | 395/104 |
| 5,168,286 | 12/1992 | Okauchi et al. | 346/76 PH |
| 5,206,687 | 4/1993 | Suzuki et al. | 399/156 |
| 5,281,998 | 1/1994 | Douglas et al. | 399/83 |
| 5,281,999 | 1/1994 | Edmunds | 399/119 |
| 5,319,464 | 6/1994 | Douglas et al. | 358/296 |
| 5,321,467 | 6/1994 | Tanaka et al. | 399/2 |
| 5,330,275 | 7/1994 | Hasewinkle | 400/82 |
| 5,373,350 | 12/1994 | Taylor et al. | 399/2 |
| 5,570,451 | 10/1996 | Sakaizawa et al. | 399/2 |
| 5,602,624 | 2/1997 | Coburn et al. | 347/2 |

OTHER PUBLICATIONS

Mar. 1990 IBM Technical Disclosure Bulletin; vol. 32; No. IOA; Modular Printer Highlighter.

*Primary Examiner*—William J. Royer
*Attorney, Agent, or Firm*—John A. Brady

[57] ABSTRACT

A computer controlled plain paper printer and image production apparatus comprising a monochromatic, laser stimulated electrophotographic printer having an optionally coupled color ink jet printer is described. The paper medium path from the laser printer is gate controlled between a direct exit path from the laser printer and a color print path into and through the ink jet printer. Both print units produce at their respective capacities and deliver recorded text and images on a paper substrate delivered to one or more discharge trays.

20 Claims, 10 Drawing Sheets

COLOR HIGHLIGHTING ACCESSORY FOR A MONOCHROMATIC PRINTER

BACKGROUND OF THE INVENTION

The present invention relates to personal computer controlled desktop publishing recorder devices. In particular, the invention relates to separate computer controlled printing devices which provide monochromatic and color text and images on a substrate.

Although numerous prior art desktop printers can rapidly print high quality monochromatic text and others can print high quality multi-color images at reasonable speeds, there are currently none that do both at a reasonable price without sacrificing speed or print quality. For example, thermal ink jet printers can produce color images of reasonable quality and cost but are relatively slow and haven't sufficient line acuity to print first quality document text. On the other hand, laser stimulated electrophotographic print engines rapidly produce good quality color images as well as monochromatic text but at great economic cost and at slow speeds.

U.S. Pat. No. 5,081,596 issued Jan. 14, 1992, to K. Vincent et al., describes a desktop printing system having a serial paper flow path, first through a laser-electrophotographic engine which prints only monochrome text. Subsequently, the paper flow route passes through a thermal ink jet printer to receive color components of the document. The two printers are linked by a registration correction station to coordinate the paper flow stream from the first printer which prints continuously, into the second printer which prints incrementally. However, every sheet passing through the first printer must also pass through the second printer regardless of the need for a color image on the sheet. This not only slows print production because an ink jet printer is inherently slower than a laser printer, but three separate devices must be aligned accurately to prevent misregistration from one device to the other.

It is an objective of the present invention, therefore, to provide a desktop printing system having a primary flow route through a monochromatic print device and an auxiliary flow route through a color print device whereby only those sheets or increments thereof requiring color are passed along the auxiliary route. All other sheets are discharged from the monochromatic auxiliary device into a first discharge tray.

Also an object of the present invention is provision of a desk top printing system having an optionally directed medium flow route from a laser printing device into a thermal ink jet color printing device whereby the user may select between a fully collated serial flow of all printed sheets through both printing devices and a divided flow route that discharges all the exclusively monochromatic imaged sheets from the flow route prior to the color printing devices.

Another object of the present invention is to provide a document highlighting or enhancement capacity for desktop publishing at a relatively modest cost.

Another object of the present invention is to provide a faster document production system for multiple sheet documents that include only relatively small portions of color.

A still further object of the invention is to provide a color printing device that may be added as an integrally operating accessory to a laser text printing device.

Yet another object of the invention is a color printing device that may be combined as an aftermarket acquisition with a laser printing device.

An additional object of the present invention is to provide a desktop printing system having the optional operating capability of isolating all color imaged sheets from a document flow stream predominately comprising monochromatic imaged sheets.

SUMMARY OF THE INVENTION

These and other objects of the invention are accomplished by a combination of personal computer directed printing devices that preferably includes a laser stimulated electrophotographic printer for monochromatic images followed by a color ink jet printing device. The color printing device is preferably a removable physical accessory to the laser printing device which is designed for coupling with the laser printing device at the discharge port of the laser printing device. A computer controlled gate in the color printing device guides selected sheets from the laser printing device into the color printing device for appropriate color application. In an alternative gate position, sheet production from the laser printing device having no highlighting or color enhancements is guided directly into the laser discharge tray without entering the color printing device.

Prior to printing monochromatic and color images, computer data representing a personal computer created document is transmitted to a raster image processor having control over the print functions. The function control program of the image processor converts, for each page of a document having color on any page, page description data from the document data into four raster matrix maps. Three of the raster maps correspond to respective color planes: the magenta; the yellow plane; and the cyan. The fourth map translates the monochromatic image data. Each raster cell or pixel in a particular map field is assigned respective address coordinates and an intensity value of the corresponding color. Intensity values are usually divided into a finite number of color shade graduations, six for example, from a complete absence of the particular color to one of five distinct shades of the primary map color. A primary color shade of one raster map may be blended with those of other maps to form a more complex spectrum for any given pixel address.

The monochromatic image map has considerably reduced data capacity requirements. Only two shades respective to devoid and maximum are necessary.

The laser printing device controller responds to the monochromatic image map for production of the map image on a medium. The medium may be a sheet of paper or substrate film of many suitable compositions.

Color plane map data is transmitted to the color printing device controller for synchronization with the monochromatic map data.

A sheet of medium such as paper is drawn from a source of supply and conveyed first to the monochromatic printing device for application of monochromatic text or graphics. If the raster map calls for no color on the field of this particular sheet, following application of the monochromatic images the sheet is transferred directly from the monochromatic printing device to a first document discharge tray. When the raster image processor calls for a colored image, however, the controller actuates a conveyor route gate to guide the sheet into the color printing device. Upon departure of the sheet trailing edge from the last monochromatic printing device roller nip, the sheet transfer rate into the color printing device is increased until the first color location on the sheet aligns with the color printhead.

The distance along the sheet conveyance route between the last monochromatic printing device roller nip and the color printing device print location is greater than the sheet maximum length so that a monochromatic image printed sheet that is transferred into the color printing device for color application is completely removed from the conveyor route of the laser printing device. Although the color recipient sheet progresses more slowly through a color ink jet printing device than the sheets progress through a monochromatic laser printing device, the laser printing device may continue production of exclusively monochromatic imaged sheets while the color sheet proceeds at the slower rate. Depending on the frequency and magnitude of colored images in a document, the entire document may be produced with only a small time penalty for color production.

Physically, the color printing device of the invention is an accessory to the monochromatic printing device and it may be operated independently of the color printing device. Moreover the color printing device is operatively joined with the monochromatic printing device with a pair of structural bayonet connectors. Electrical connection is by means of a dedicated cable and pin connection.

BRIEF DESCRIPTION OF THE DRAWINGS

The present invention may be further understood by reference to the following description and drawings which illustrate a preferred embodiment of the invention. With reference to the drawings.

DETAILED DESCRIPTION OF THE PREFERRED EMBODIMENT

Figure 1:
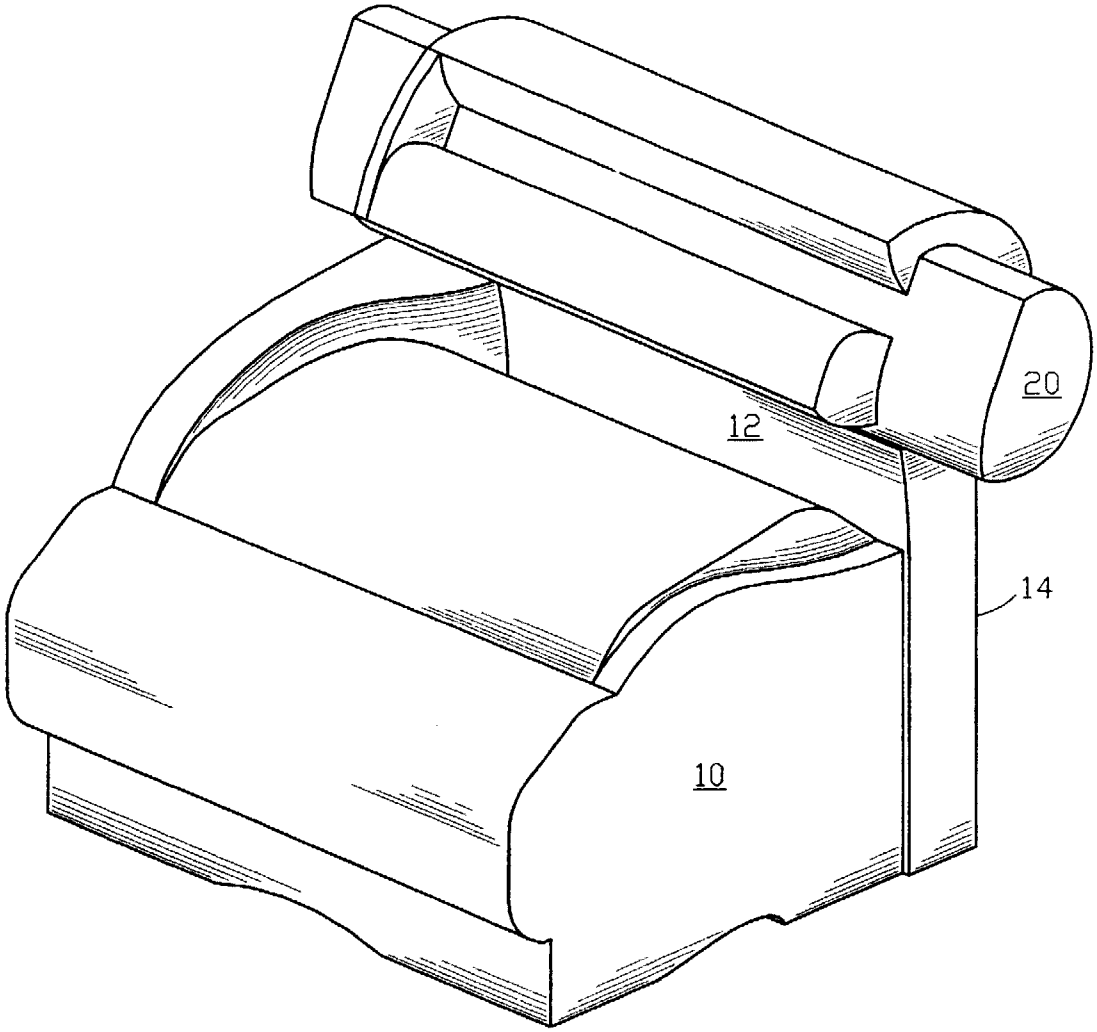
FIG. 1 is a pictorial of the invention in operative assembly.
Figure 2:
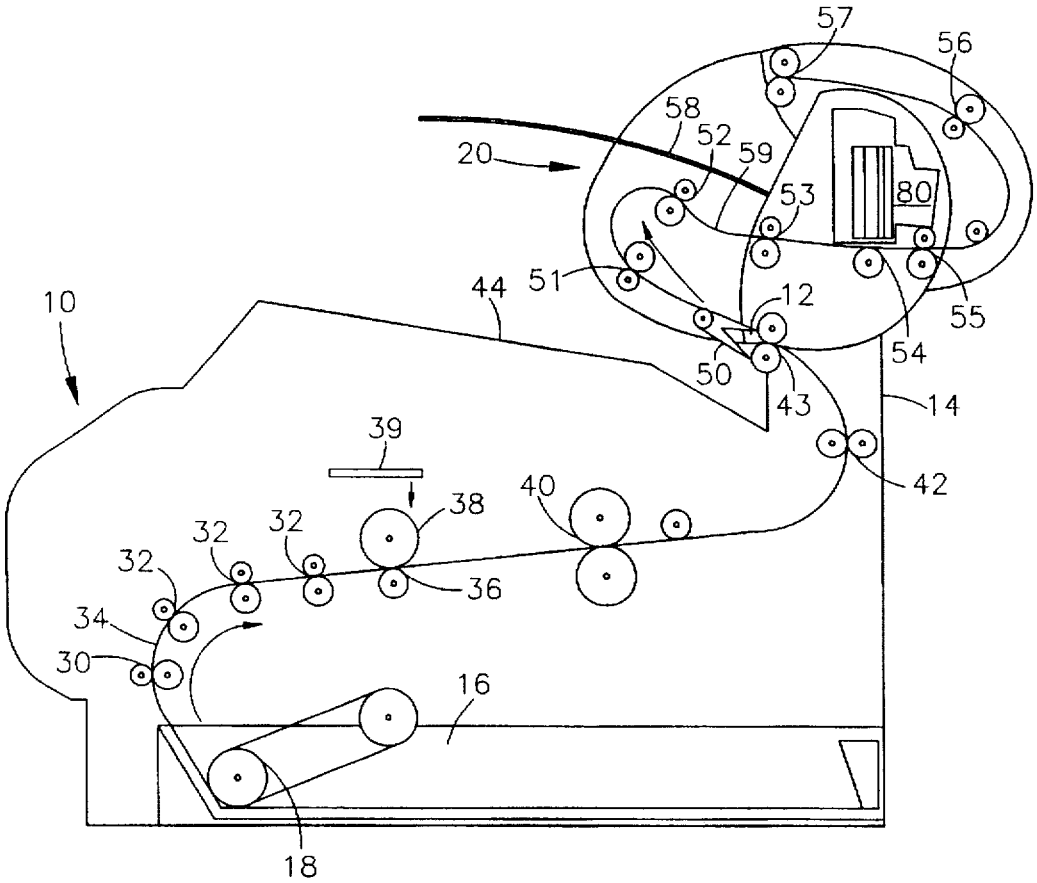
FIG. 2 is a sheet medium flow schematic of the invention.

Referring to the drawings wherein like reference characters designate like or similar elements throughout the several figures of the drawing, FIGS. 1 and 2 illustrate the invention as including a base printer 10 which supports a color printing accessory 20 operatively connected to the base printer and having a sheet product discharge channel 12 along the base printer back wall 14. As is conventional with a laser stimulated electrophotographic printer, a sheet medium supply tray 16 includes an automatic sheet pickup means 18 for placing a single sheet into the nip of a first pair of driven rollers 30. Subsequent roller nips 32 define a sheet conveyor route 34 into and from an image transfer nip 36 whereat a photoconductor drum 38 deposits a pattern of monochromatic toner, usually black, on the sheet surface corresponding to the desired image characteristics defined by laser printhead. The fuser roll station 40 thermally sets the toner particulates into or upon the sheet surface. From the fuser, the sheet is further driven by feed rolls 42 and 43. Discharge roller set 43 will drive the sheet into the laser printer discharge collection tray 44 unless deflected from that route by gate 50. All of these dynamic mechanical elements such as the rollers, the photoconductor drum and the fuser are enclosed within relatively thin shell walls for protection from dirt, dust and moisture.

Figure 4:
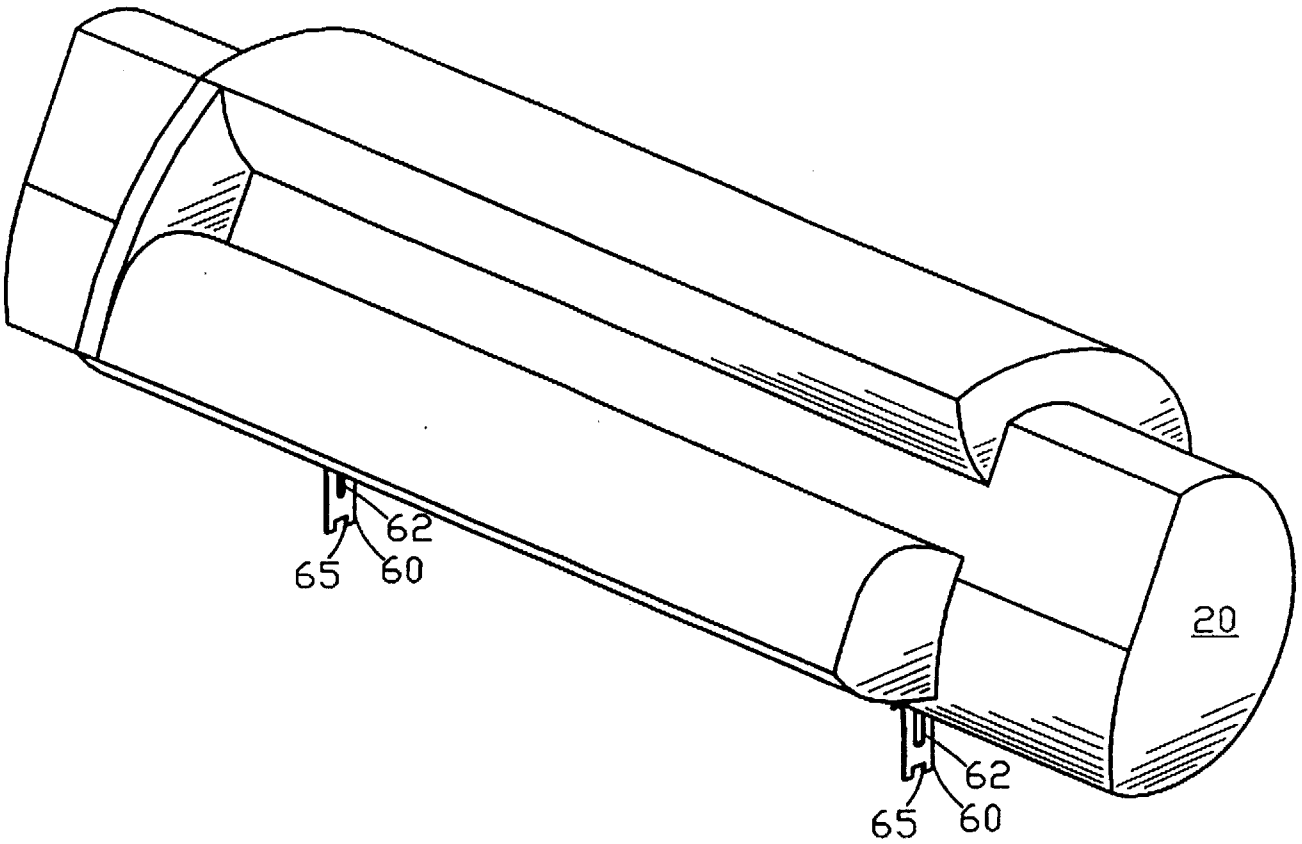
FIG. 4 is a front pictorial of the color printing device of the invention in isolation from the laser printer.
Figure 5:
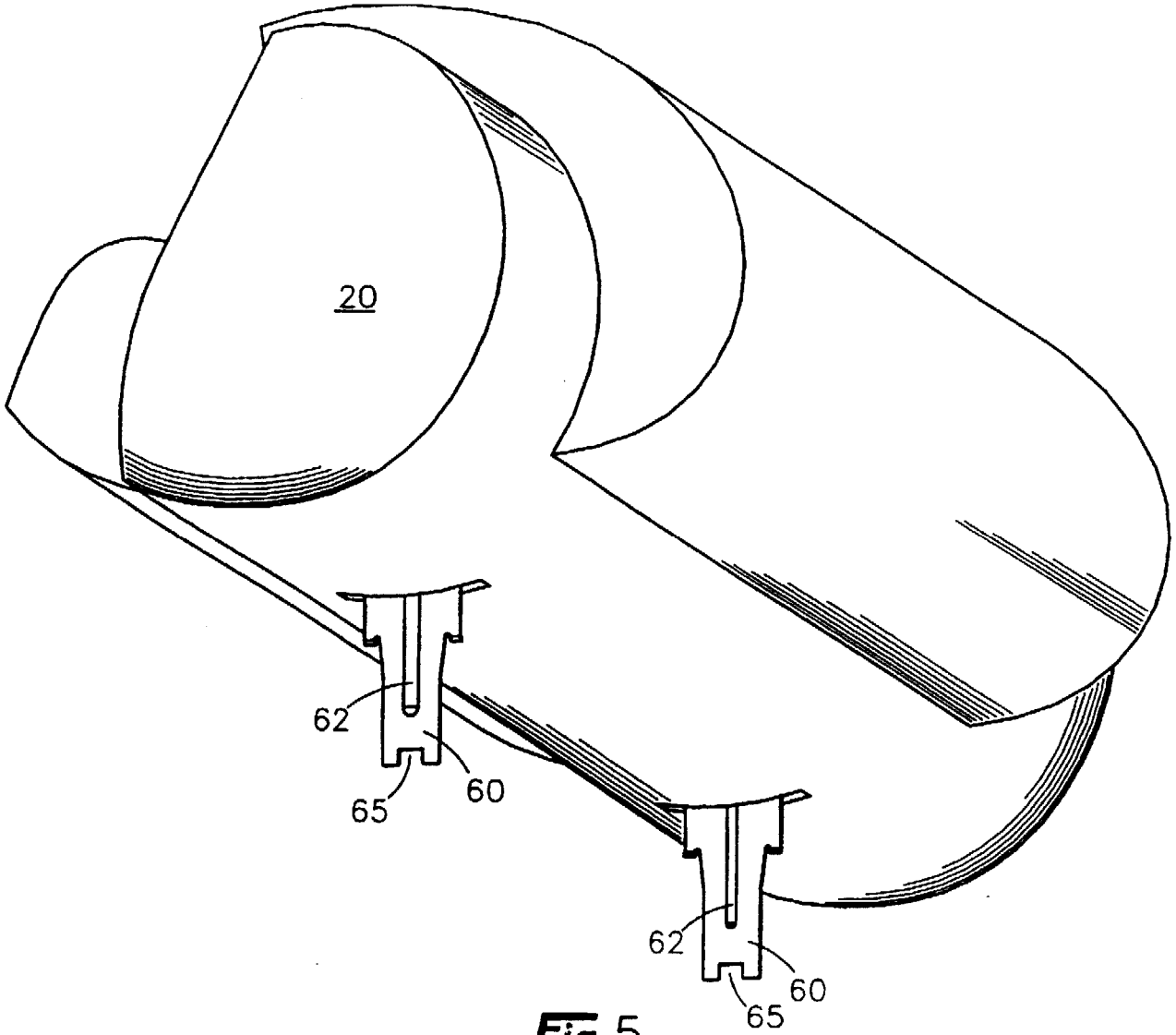
FIG. 5 is a bottom pictorial of the color printing device of the invention in insolation from the laser printer.
Figure 6:
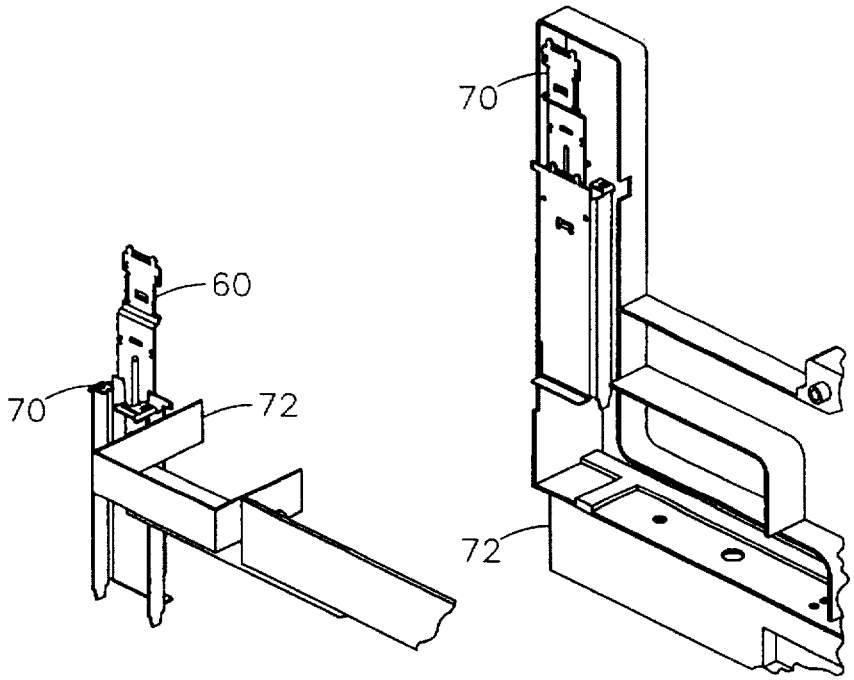
FIG. 6 is a first angle isometric view of the bayonet connectors of the invention.
Figure 7:
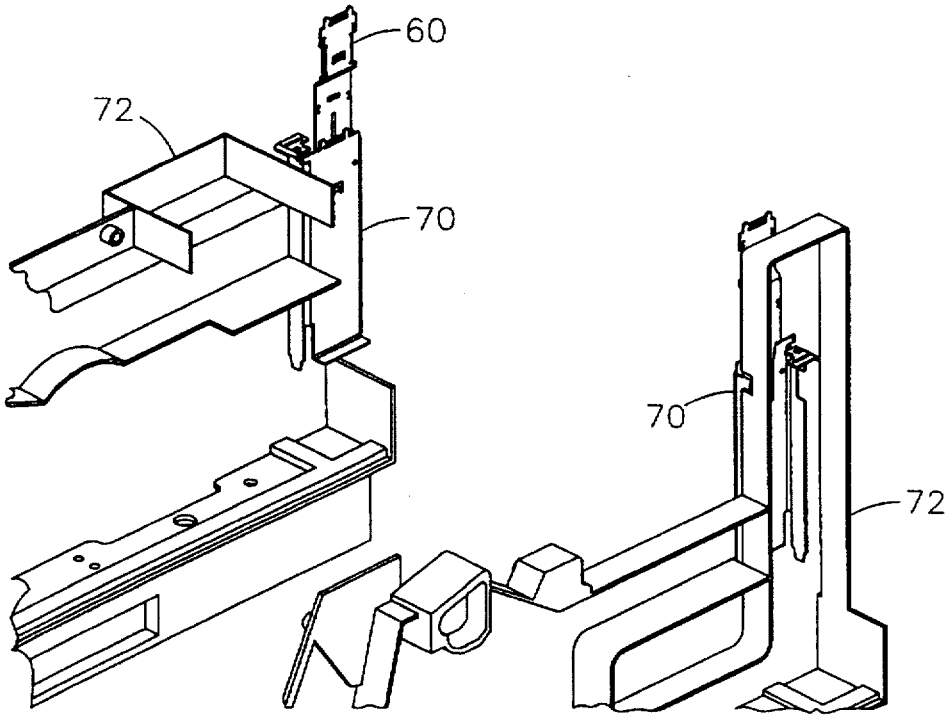
FIG. 7 is a second angle isometric view of the bayonet connectors of the invention.
Figure 8:
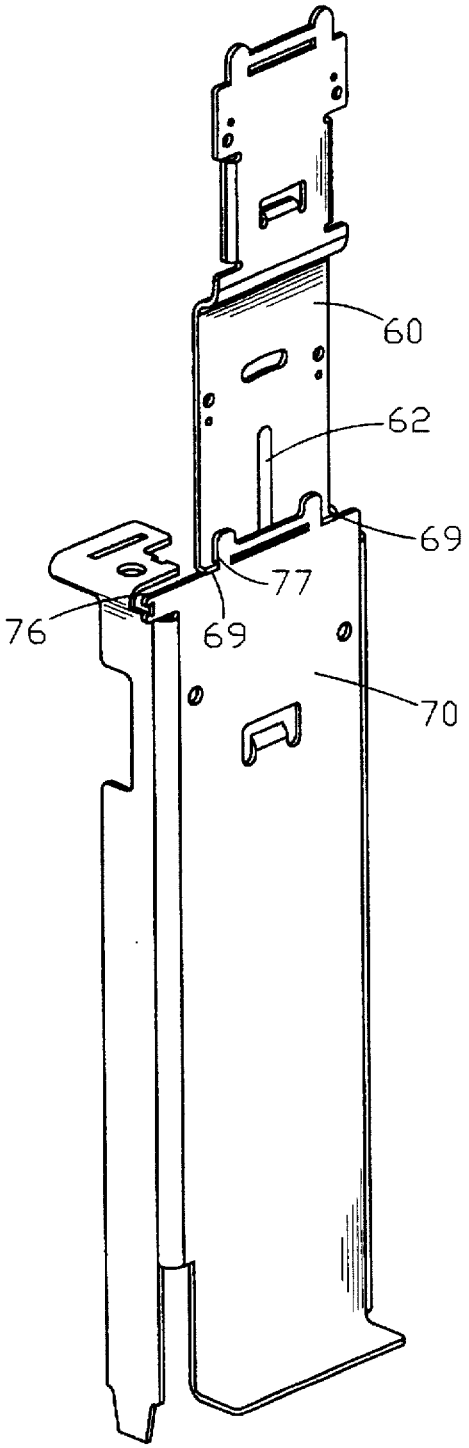
FIGS. 8, 9 and 10 are isometric details of the bayonet connectors of the invention.
Figure 9:
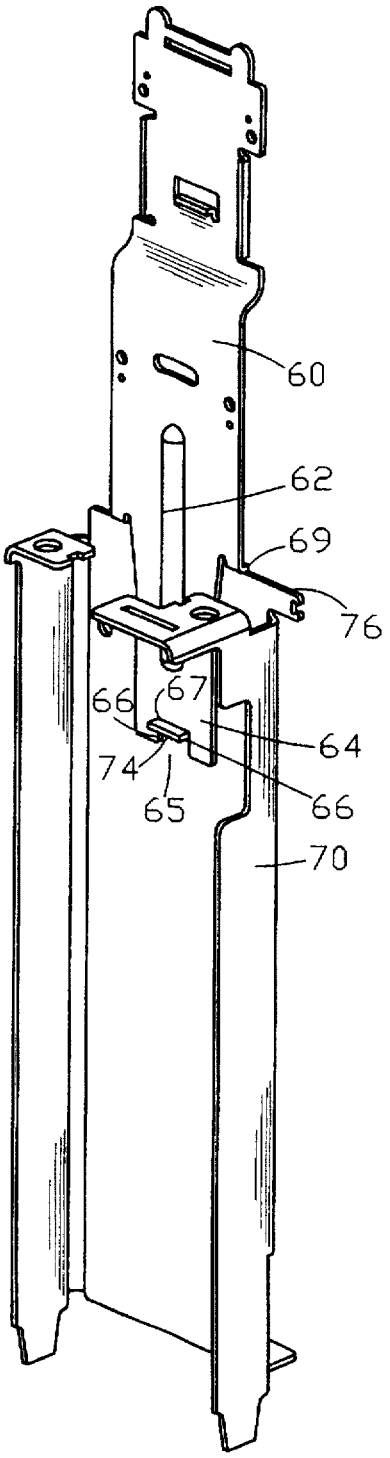
Figure 10:
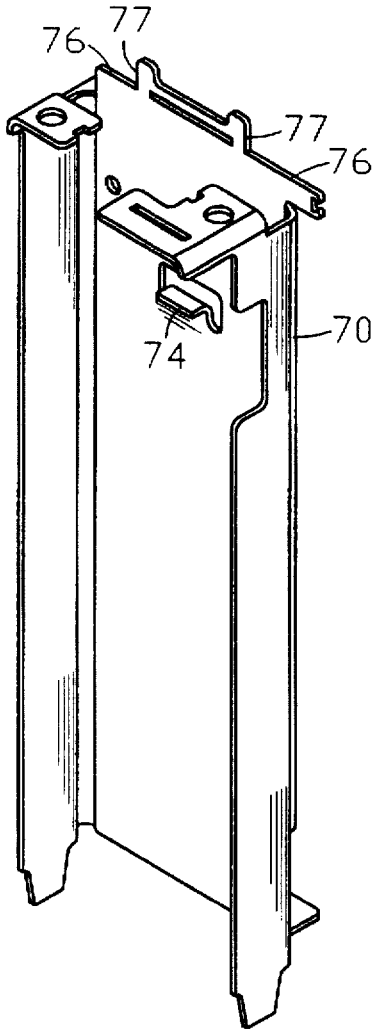

Gate 50 is an operating component of the color printer unit 20 which is structurally supported upon the base printer 10 by bayonet blades 60 (FIG. 4) secured to the color unit 20. These bayonet blades 60 socket into a bayonet scabbard 70 shown by FIGS. 8, 9 and 10 that is structurally secured to the base printer 10 frame members 72 as shown by FIGS. 6 and 7. To enhance rigidity of this blade-scabbard connection, a multiplicity of opposing abutment surfaces are provided. Bending rigidity of the blade 60 length is stiffened by a press formed rib 62 midway along the blade length.

A reduced width center section 64 of the blade 60 is notched 65 by laterally opposed abutment edges 66 and a bight edge bight edge 67. This notch 65 and its respective abutment edges 66 and 67 cooperate with a tab projection 74 from the scabbard 70.

Flanking the blade center section 64 are a pair of blade tabs 69. The turned faces of these tabs 69 abut the scabbard shoulder edges 76 whereas the inside edges of blade tabs 69 abut the scabbard neck edges 77.

Planar engagement of the blade 60 with the scabbard 70 permits the tab and edge abutment surfaces to wedge into a zero clearance fit thereby allowing no relative movement in the blade plane. Once seated, the only relative movement the fit allows is extraction of the color printing accessory 20 from the base printer 10 along the blade plane and directional axis.

Bayonet scabbards 70 are secured to the base printer 10 frame outside of the conveyor route 34 but internally of external shell walls which form an enclosed column around feed rolls 42 and 43. Such proximity aligns the color unit gate 50 very closely with the discharge roll 43. When the gate 50 is turned to the upper position, a sheet discharged by the roll set 43 is directed into the monochromatic tray 44. When the gate 50 is turned to the lower position, however, sheets discharged from the roll set 43 are guided into the color print unit 20.

Referring again to FIG. 2, operation of the color accessory 20 is coordinated to the base printer 10 so that when the gate 50 is down, the linear speed of color accessory feed roll 51 is the same as the base printer discharge roll 43 until the sheet clears the roll 43 nip. When the sheet is clear of roll nip 43, the color accessory feed rolls 51, 52 and 53 accelerate to a speed significantly greater than the base printer throughput speed until a point of color application to the sheet reaches the print application point 54 of the color print head 80. From that moment, the color sheet proceeds past the application point 54 at a state of the art color ink jet print rate until all of the color required of that image has been deposited on the sheet. When an image is completed on a given sheet, the color print rolls 51, 52 and 53 again accelerate until the first element of the next color image aligns with the color engine application point 54. When the colored sheet tail emerges from the print application point 54, the sheet is discharged at the greater conveyance rate into the color tray 58 by transfer rolls 55, 56 and last feed roll 57.

It is to be noted that the linear distance along the sheet route 59 into the color printer 20 from the base printer discharge roll 43 to the color print head 80 application point 54 is greater than a sheet maximum length. Consequently, unless a preceding sheet already occupies the route 59, a sheet emerging from the base printer 10 into the color printer sheet route will completely clear the base printer sheet feed route. If the next successive sheet through the base unit 10 is exclusively monochromatic, the gate 50 will rise and direct the next monochromatic sheet into the discharge tray 44 while a preceding color sheet advances through the color printer 20.

Figure 3:
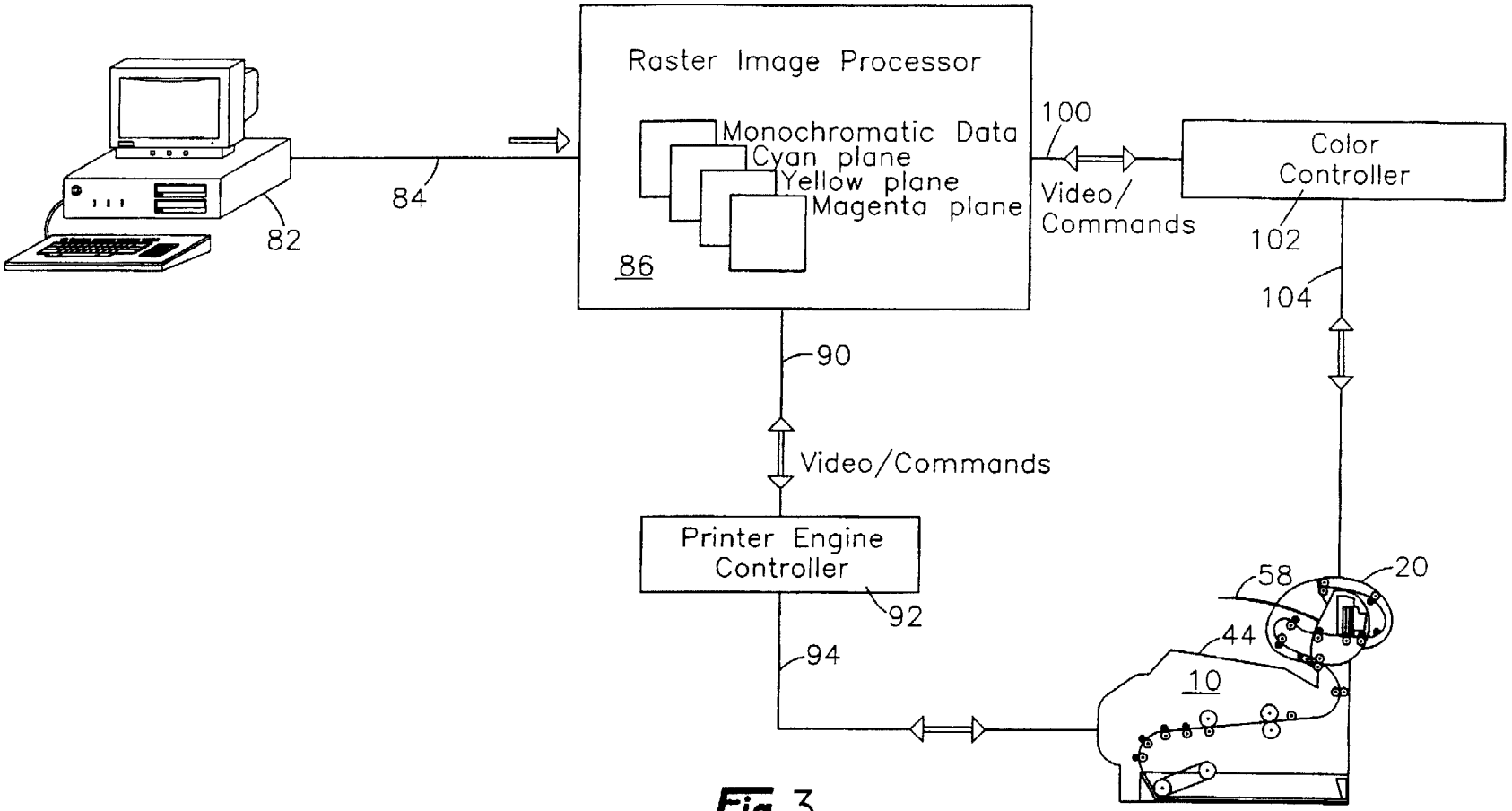
FIG. 3 is a control signal flow schematic of the invention.

The strategy of the foregoing print and sheet control is carried out by a program schematically illustrated in FIG. 3 to include a data transmission link 84 between a data processing unit 82 and a Raster Image Processor 86. Here the data flow is segregated into four digital maps coordinated to the sheet field. One of such maps is for the monochromatic image normally printed by base unit 10. The other three data maps generated by the image processor correspond to the respective primary colors of cyan, yellow and magenta to be printed by the color accessory 20.

Data link 90 transmits the monochromatic image data map to a print engine controller 92 respective to the base printer 10. A control signal link 94 carries the respective operating commands to the print mechanism for execution of printed images on a respective sheet reflective of the monochromatic image data map.

Data link 100 transmits the primary color data map to a color printing device controller 102 respective to the color print accessory 20. Control signal link 104 delivers color printing device controller 102 signals to the color printer control mechanism.

A synergistic benefit of the present invention is the result of prior thermal print processing on the speed and operating efficiency of a subsequent color ink jet printer. The hot sheet surface generated by the fuser 40 favorably augments operation of the color ink jet printing device so as to produce better color images at a faster rate.

Figure 11:
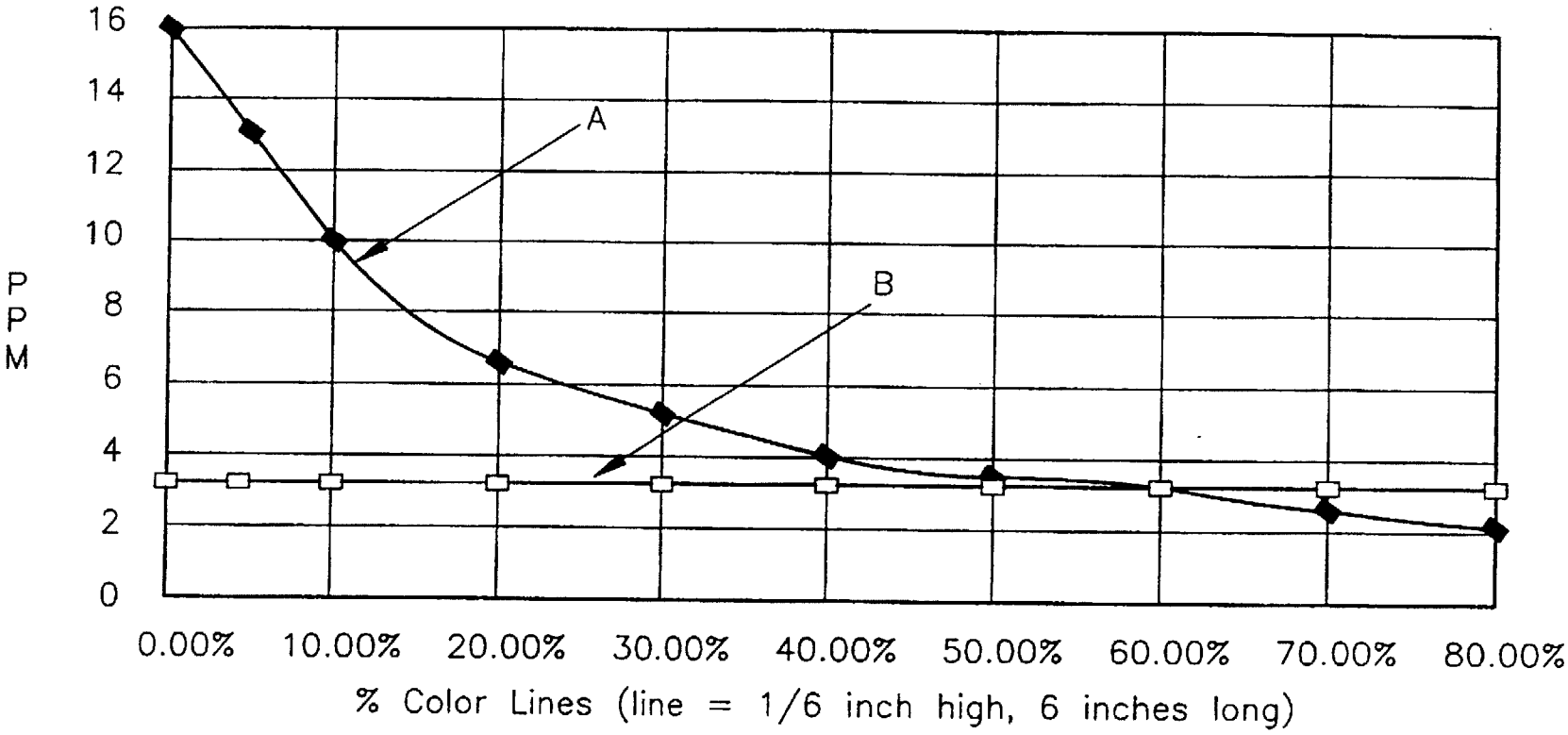
FIG. 11 is an operating comparison graph for the printing device of the present invention.

The operational advantage of the invention is readily comprehended from the comparison graph of FIG. 11 in which graph line A reports the pages per-minute production rate of the present invention and graph line B represents the production rate of an ink jet printer for both color sheets and monochromatic images. These page-per-minute production rates, charted along the graph ordinate, are coordinated with percentages of line color relative to total line production along the graph abscissa.

At the abscissa origin with no color in a production flow, the laser printer 10 maximum production rate dominates with 16 pages-per-minute of exclusively monochromatic images. The color ink jet printer, however, obtains no speed advantage from an exclusive monochromatic image production. Its speed is three pages-per-minute regardless of the color quantity in the image.

Of course, as the percentage of colored lines in a printed image increases, the production rate of the printed sheets declines exponentially. Nevertheless, colored line presence in a document must exceed 60% before the performance of the device of the present invention is less than a dedicated color ink jet printer.

While preferred embodiments of the present invention are described above, it will be appreciated by those of ordinary skill in the art that the invention is capable of numerous modifications, rearrangements and substitutions of parts without departing from the spirit and scope of the appended claims.

We claim:

1. A computer controlled printing system comprising:

a first printing device for printing substantially monochromatic images on a sheet medium;

a second printing device operatively connected to the first printing device for printing color images on a sheet medium;

a first sheet conveyor route directed past said first printing device and towards a first discharge position;

a computer controlled gate for selectively deflecting a sheet moving in said first sheet conveyor route away from said first printing device from first discharge position and toward said second printing device;

a second sheet conveyor route directed through the second printing device past a color print head to a second discharge position; and, gate control means for selectively setting said gate to direct a particular sheet medium toward said first or said second discharge position.

2. A printing system as described by claim 1 wherein said first printing device is an electrophotographic printer and said second printing device is an ink jet printer.

3. A computer controlled printing system comprising:

an electrostatic printer for printing substantially monochromatic images on a sheet medium;

an ink jet printer operatively connected to the electrostatic printer for printing color images on a sheet medium;

a first sheet conveyor route directed past said electrostatic printer toward a first discharge position;

a computer controlled gate for selectively directing a sheet from said first discharge position and toward said ink jet printer;

a second sheet conveyor route directed through said ink jet printer past a color print head to a second discharge position; and, gate control means for selectively setting said gate to direct a particular sheet medium toward said first or said second discharge position wherein sheet medium travel distance along said second sheet conveyor route between said gate and said ink jet printer is greater than the distance between a sheet leading edge and trailing edge.

4. A printing system as described by claim 3 further comprising sheet speed control means to drive a second sheet along said second sheet conveyor route between said gate and said ink jet printer at a greater speed than a first sheet medium is driven through said electrostatic printer.

5. A computer controlled printing system comprising:

a first printing device for printing substantially monochromatic images on a sheet medium;

a second printing device operatively connected to the first printing device for printing color images on a sheet medium;

a first sheet conveyor route directed past said first printing device and toward a first discharge position;

a computer controlled gate for selectively directing a sheet from said first discharge position and toward said second printing device;

a second sheet conveyor route directed through the second printing device past a color print head to a second discharge position; and, gate control means for selectively setting said gate to direct a particular sheet medium toward said first or said second discharge position, wherein said gate control means comprises raster image data processing means for controlling the position of said gate by the presence of color image data respective to a particular sheet of medium.

6. A computer controlled printing system comprising:

a first printer for printing substantially monochromatic images on sheet medium conveyed along a first conveyance route to a first discharge position;

a second printer for printing multicolor images on sheet medium conveyed along a second conveyance route between said first discharge position and a second discharge position; and, connector means for selectively securing said second printer to said first printer to receive a sheet medium from said first conveyance route.

7. A printing system as described by claim 6 wherein said first printer is an electrophotographic printer and said second printer is an ink jet printer.

8. A printing system as described by claim 7 wherein said second printer further comprises gating means to direct a particular sheet of medium away from said second conveyance route and into a first discharge receptacle.

9. A printing system as described by claim 7 wherein said second printer further comprises gating means to direct sheets with only monochromatic images thereon into a first discharge receptacle.

10. A printing system as described by claim 6 wherein said connector means comprises at least a pair of bayonet fasteners having a scabbard receptacle secured to the first printer and a cooperative blade plug secured to the second printer.

11. A computer controlled printing system comprising:

a monochromatic image printing device for printing computer directed characters and images on a first sheet medium having leading and trailing edges in a substantially single, predetermined color, said first sheet medium being conveyed through said first printing device by a first conveyor means at a first conveyor speed regulated by a first conveyor controller;

a multicolor printing device operatively connected to the monochromatic image printing device for printing computer directed characters and images on said first sheet medium in a variety of colors, said first sheet medium being conveyed through said multicolor printing device by second conveyor means at a second conveyor speed regulated by a second conveyor controller, said second conveyor means being aligned to receive said first sheet medium from said first conveyor means;

sheet transition control means for sensing the passage of said first sheet medium trailing edge from said first conveyor means to increase the conveyor speed of said sheet medium greater than said first conveyor speed until a position along said first sheet medium aligns with a print application position of said multicolor printing device.

12. A system as described by claim 11 wherein the distance along said second conveyor means between said first conveyor means and said multicolor printing device is greater than the maximum distance between said sheet leading and trailing edges.

13. A system as described by claim 11 further comprising gate means to selectively direct a second sheet medium away from said second conveyor means and said multicolor printing device.

14. A computer controlled printing system comprising;

a first printer for printing computer directed images on sheet medium conveyed along a first conveyance route to a first discharge position;

printer accessory means for conveying sheet medium from said first discharge position to a second discharge position;

first structural connection means secured to said first printer proximate of said first discharge position; and, second structural connection means secured to said accessory means for mating with said first structural connection means for removably attaching said accessory means to said first printer in operational alignment with said first discharge position whereby a sheet medium is transferred from said first discharge position to said second discharge position.

15. A printing system as described by claim 14 wherein said accessory means comprises a computer controlled gate means for selectively directing a particular sheet of medium from said first discharge position to said second discharge position.

16. A method of printing computer generated images upon sheet medium, said method comprising the steps of: .

transferring a sheet of medium along a first conveyor route to a monochromatic printing device for receipt of monochromatic images thereon;

transferring a first sheet medium along a second conveyor route from said monochromatic printing device to a first discharge position;

transferring a second sheet medium along a third conveyor route from said monochromatic printing device to a multicolor printing device for receipt of color images thereon;

transferring said second sheet medium along a fourth conveyor route from said color printing device to a second discharge position; and, selectively deflecting successive sheets of medium moving in said second conveyor route away from said monochromatic printing device to said second or third conveyor routes.

17. A method as described by claim 16 further comprising the step of processing image data to distinguish a first sheet having only monochromatic images thereon and a second sheet having an image of at least two colors thereon.

18. A method as described by claim 17 wherein said image data processing step generates gate control signals to direct successive sheets of medium along second or third conveyor routes.

19. A method as described by claim 16 wherein said color printing device, third conveyor route and fourth conveyor route are selectively detached from said monochromatic printing device, and said first and second conveyor routes.

20. A method as described by claim 16 wherein the transfer rate of said second medium sheet along said third conveyor route is greater than the transfer rate of said first medium sheet along said second conveyor line.

* * * * *